US008910710B2

(12) United States Patent
Krauss

(10) Patent No.: US 8,910,710 B2
(45) Date of Patent: Dec. 16, 2014

(54) PUMPJACK PRODUCTION CONTROL

(75) Inventor: Alan Frederick Krauss, Knightdale, NC (US)

(73) Assignee: Schneider Electric USA, Inc., Palatine, IL (US)

( * ) Notice: Subject to any disclaimer, the term of this patent is extended or adjusted under 35 U.S.C. 154(b) by 594 days.

(21) Appl. No.: 13/114,508

(22) Filed: May 24, 2011

(65) Prior Publication Data

US 2012/0298375 A1 Nov. 29, 2012

(51) Int. Cl.
*E21B 43/12* (2006.01)
*E21B 47/00* (2012.01)

(52) U.S. Cl.
CPC ..... *E21B 47/0008* (2013.01)
USPC ..... 166/250.15; 166/369; 166/53; 417/20

(58) Field of Classification Search
CPC ..... E21B 43/00; E21B 43/12; E21B 44/00; E21B 47/0008
USPC ..... 166/369, 53, 250.15; 417/53, 12, 20, 417/36, 44.1
See application file for complete search history.

(56) References Cited

U.S. PATENT DOCUMENTS

| | | | | | |
|---|---|---|---|---|---|
| 3,269,320 | A | * | 8/1966 | Fredriksson et al. | 417/12 |
| 3,851,995 | A | | 12/1974 | Mills | |
| 4,318,674 | A | | 3/1982 | Godbey et al. | |
| 4,390,321 | A | * | 6/1983 | Langlois et al. | 417/15 |
| 4,541,274 | A | * | 9/1985 | Purcupile | 73/152.61 |
| 4,859,151 | A | | 8/1989 | Reed | |
| 4,972,705 | A | | 11/1990 | Fryer et al. | |
| 4,973,226 | A | * | 11/1990 | McKee | 417/18 |
| 5,044,888 | A | | 9/1991 | Hester, II | |
| 5,064,349 | A | * | 11/1991 | Turner et al. | 417/53 |
| 5,284,422 | A | | 2/1994 | Turner et al. | |
| 5,372,482 | A | | 12/1994 | London et al. | |
| 5,441,389 | A | | 8/1995 | Wolcott et al. | |
| 5,634,522 | A | | 6/1997 | Hershberger | |
| 5,829,530 | A | | 11/1998 | Nolen | |
| 6,176,682 | B1 | | 1/2001 | Mills | |
| 6,599,095 | B1 | | 7/2003 | Takada et al. | |
| 6,631,762 | B2 | | 10/2003 | Collette | |
| 7,083,391 | B2 | * | 8/2006 | Sievert et al. | 417/42 |
| 2010/0038078 | A1 | | 2/2010 | Fink | |
| 2010/0101774 | A1 | * | 4/2010 | Ocondi et al. | 166/66 |
| 2011/0103974 | A1 | * | 5/2011 | Lamascus et al. | 417/45 |

OTHER PUBLICATIONS

Lea, et al., "What's New in Artificial Lift", article from World Oil Online, vol. 227, No. 4, Apr. 2006, downloaded from <http://www.worldoil.com/April-2006-Whats-new-in-artificial-lift.html>, 13 pages.

Telemecanique, "ATV 71 Beam Pump Controller User Manual," , 34 pages, Nov. 8, 2007.

* cited by examiner

*Primary Examiner* — Yong-Suk (Philip) Ro
(74) *Attorney, Agent, or Firm* — Banner & Witcoff, Ltd.

(57) ABSTRACT

A method, software, and apparatus for controlling a pump configured to pump liquid out of a well. Such control may involve determining whether a production rate of gas from the well is increasing, decreasing, or steady, and whether to switch the pump between an OFF state and an ON state. Whether the pump is switched may depend upon whether the production rate of the gas is determined to be increasing, decreasing, or steady.

18 Claims, 6 Drawing Sheets

PUMPJACK PRODUCTION CONTROL

BACKGROUND

Pumpjack systems often include a pump-off controller that switches a pump between an ON state and an OFF state based on how long the pump has been in a particular state. These pump-off controllers may also switch the pump to the OFF state when a pump-off condition is detected, such as an underfilled pump stroke. In some systems, the well is intended for producing gas, and the pump is used to remove largely undesirable liquid from the well (to make room for the gas to enter the well for extraction). In these types of wells, the pump may run regardless of whether liquid extraction at a given time is beneficial to gas production.

SUMMARY

Various aspects are described herein that may provide, for example, systems, methods, and software for controlling a pump, such as a pump that is configured to pump liquid out of a gas-producing well. The state of the pump may be controlled based on feedback information regarding the rate of a product being produced by the well. For example, where gas (e.g., natural gas) is being produced by the well, the pump may be switched between the ON state and the OFF state depending upon whether the production rate is determined to be increasing, decreasing, or steady. The switching of the pump from the OFF state to the ON state may also be based on a parallel decision based on whether a pump off condition has been reached. Moreover, the pump off time may be adjusted based on the determined production rate.

This type of pump control may allow for a system that is biased toward running the pump only when deemed necessary in accordance with the determined production rate. This may potentially allow for the system to be more efficient by not running the pump when it would likely not provide any benefit. This may be in contrast to simpler pump-off controllers that control the pump based merely on timers and/or on detected traditional pump-off conditions. Moreover, the proposed pump control may be used in conjunction with traditional time-based control and/or traditional pump-off condition-based control. In some cases, the additional control functionality may even be retrofitted to traditional pump-off controllers.

According to some aspects as described herein, example methods, software, and apparatuses are described for controlling a pump configured to pump liquid out of a well. Such control may involve, for example, determining whether a production rate of gas from the well is increasing, decreasing, or steady; determining whether the state of the pump should be changed depending upon whether the production rate of the gas is determined to be increasing, decreasing, or steady; and responsive to determining to that the pump should be switched, changing the state of the pump.

The techniques described herein may be utilized in connection with various types of pump systems, such as, but not limited to, a pumpjack system for pumping water and liquid oil, and for producing natural gas from a well.

These and other aspects of the disclosure will be apparent upon consideration of the following detailed description.

BRIEF DESCRIPTION OF THE DRAWINGS

A more complete understanding of the present disclosure and the potential advantages of various aspects described herein may be acquired by referring to the following description in consideration of the accompanying drawings, in which like reference numbers indicate like features, and wherein.

DETAILED DESCRIPTION

Figure 1:
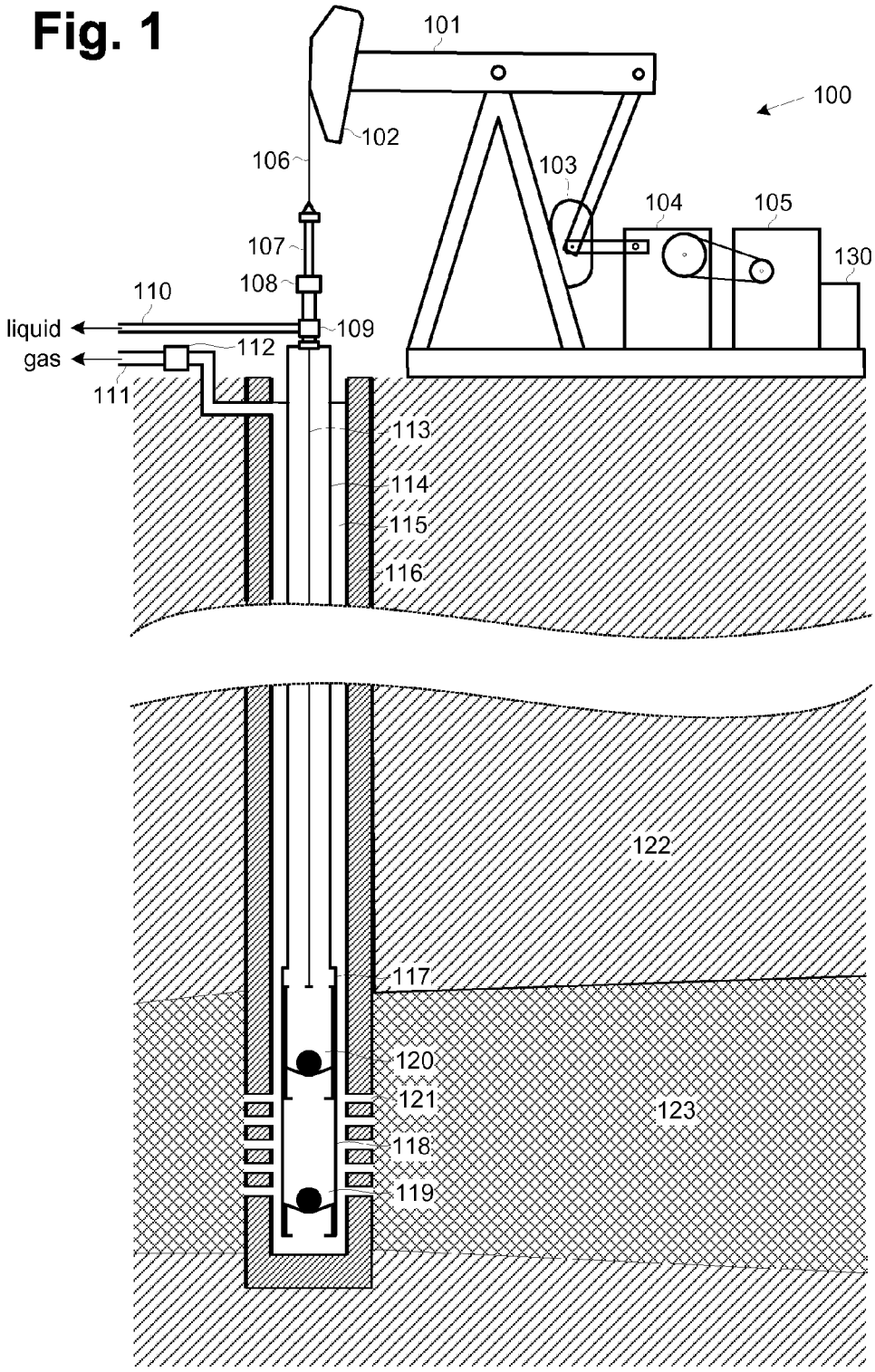
FIG. 1 is a cross-sectional view of an example pumpjack system.

FIG. 1 is a cross-sectional view of an example pumpjack system 100. Such a system 100 may include an above-ground structure that includes a walking beam 101 onto which a horse head 102 is mounted. Walking beam 101 may reciprocate so as to move horse head 102 upward (up stroke) and downward (down stroke) on a periodic basis. To move walking beam 101, a controller 130 may command a prime mover 105 (such as a motor) to send rotational power to a transmission 104, which may include a gear reducer that causes a crank arm and counter weight 103 to rotate at a reduced rotational speed and increased torque relative to prime mover 105. Because counter weight 103 is offset from its rotational axis, this causes an arm attached to walking beam 101 to move walking beam 101 in a reciprocating manner.

As horse head 102 moves up and down, this causes a string 106 (also known as a birdie) that is usually made of a steel cable to also move up and down. In turn, this movement causes a polished rod 107 to move up and down through a lubricated stuffing box 108, which in turn causes a sucker rod 113 (typically made of a series of longitudinally interconnected steel rods) attached to the lower end of polished rod 107 to also move up and down.

Sucker rod 113 extends downward into a well in ground 122, through tubing 114 to a downhole pump 117. A hollow annular region, referred to herein as annulus 115, encircles tubing 114 and is disposed between tubing 114 and an outer casing 116. Casing 116 includes a series of perforations 121 that expose annulus 115 to an oil or gas bearing region 123 of ground 122. Liquids, such as oil and water, and gases, such as hydrocarbon gases (e.g., methane, ethane, etc.) enter perforations 121 into annulus 115 through a combination of outside pressure and a vacuum produced by downhole pump 117. Liquids fall to the bottom of annulus 115 due to gravity, and gases (being lighter than the liquids) rise upward in annulus 115.

Figure 2:
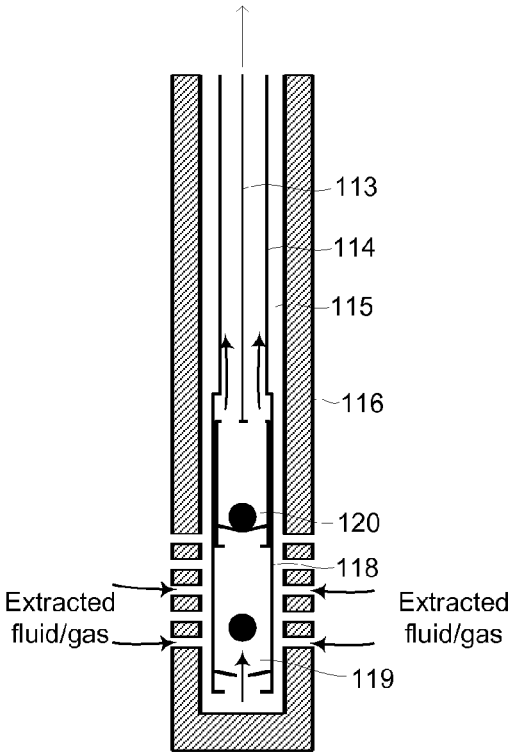
FIG. 2 is a cross-sectional view of an example downhole pump in operation during an up stroke.

Downhole pump 117 may include a standing valve 119, a travelling valve 120 coupled to sucker rod 113, and a hollow region referred to as a pump barrel 118 disposed between the standing and travelling valves 119, 120. Downhole pump 117 typically operates as follows. Referring to FIG. 2, as sucker rod 113 moves in an up stroke, liquid above travelling valve 120 causes travelling valve 120 to close, and so the upward movement creating a vacuum between travelling valve 120 and standing valve 119. This causes standing valve 119 to open, allowing liquid that has accumulated at the bottom of annulus 115 to be drawn up through standing valve 119. Meanwhile, if tubing 114 is sufficiently already full of previously pumped liquids, then the liquid at the top of the liquid stack in tubing 114 is pushed upward an outward through a junction 109 and an exit tube 110 for collection and/or disposal.

Figure 3:
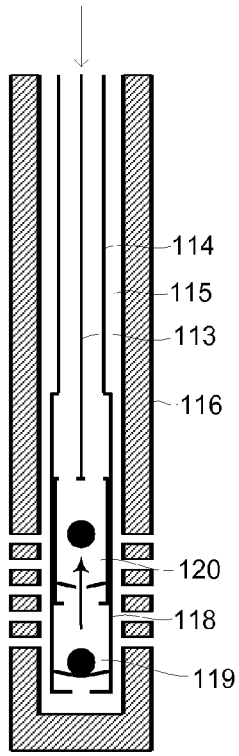
FIG. 3 is a cross-sectional view of an example downhole pump in operation during a down stroke.

On the down stroke (FIG. 3), sucker rod 113 moves downward, also causing travelling valve 120 to move downward. This produces a relatively higher pressure between travelling valve 120 and standing valve 119, causing it to open and travel downward through the liquid that previously passed through standing valve 119 on the up stroke. The higher pressure also causes standing valve 119 to close, thereby forcing the previously-drawn liquid to remain in place while travelling valve 120 moves downward through that liquid. By alternating up and down strokes, downhole pump 117 may therefore draw liquids that have fallen to the bottom of annulus 115 up and out of the well.

As previously explained, while liquids fall to the bottom of annulus 115, gases tend to rise upward in annulus 115. Thus, depending upon the level of the liquid at the bottom of annulus 115 relative to the intake of downhole pump 117, gases are ideally not pumped through downhole pump 117. Instead, gases may be collected and/or disposed of from the well through an exit tube 111 disposed at or near the top of annulus 115. A measurement device 112 may be coupled to exit tube 111 for measuring the volume and/or rate of the gas traveling through exit tube 111.

Depending upon the desired product to be produced by the well, either the gas, or the liquid, or both the gas and the liquid may be considered a production product. Likewise, depending upon what is desired, the gas or the liquid may be considered a waste product. For example, depending upon where the well is located, the well may produce an excellent supply of oil, whereas the gas also produced may be an unwanted byproduct or it may be a useful product. In this case, downhole pump 117 may be used to pump the desirable oil (along with other liquids such as water). Or, where gas is considered the main product to be produced by the well, such as where the well is located in a region that contains little to no liquid petroleum product to be extracted, then the waste liquid may primarily include water (with various contaminants). In this case, the downhole pump 117 may be used to draw up the waste liquid simply to prevent annulus 115 from becoming full of the liquid and thereby preventing the desirable gas product from entering annulus 115.

Pumpjack system 100 may operate continuously or on a periodic basis, under the control of controller 130. For example, controller 130 may cause prime mover 105 to continuously run so as to cause pumpjack system 100 to perform a series of stroke cycles (each stroke cycle including a pair of an upstroke and a downstroke). Such continuous operation may carry on until a pump off condition occurs. A pump off condition may occur where, for instance, it is determined that there is insufficient liquid in annulus 115 to be pumped by downhole pump 117. Continuing to pump under such a condition may result in conditions that can cause damage to the pumpjack system 100. A pump off condition may also occur due to a timeout. For instance, controller 130 may be configured so as to continuously cause pumpjack system 100 to pump for X amount of time or until another pump off condition is met, whichever occurs first. In other examples, pumpjack system 100 may be controlled to perform only a single stroke cycle at a time, with a delay between cycles. In still further examples, pumpjack system 100 may be controlled to adjust the speed of a stroke. The stroke speed, continuous duration, stroke frequency, and/or delay between stroke cycles may be set so as to, ideally, minimize energy expended, minimize pumpjack system wear, and maximize production. All of these can depend upon a variety of factors. For example, if liquid is drawn through perforations 121 into annulus 115 very quickly and easily, then pumpjack system 100 may need to operate downhole pump 117 more often or on a more continuous basis. Otherwise, the liquid level in annulus 115 may rise too high, reducing the efficiency of the system especially where gas is the desired product (since there will be less room in annulus 115 for the gas). On the other hand, if liquid is not drawn quickly through perforations 121, then the liquid level may be too low in annulus 115 unless pumping is reduced. As discussed above, this may allow gas to be pumped up through downhole pump 117, potentially causing production loss, gas lock and/or equipment damage.

As can be seen, there is accordingly a level, or range of levels, at which the liquid level in annulus 115 should be maintained to provide a desired system efficiency. In an ideal world, one might directly measure the liquid level and control pumpjack system 100 based on the direct measurement. While such an arrangement has been proposed, this is not always practical, because downhole pump 117 may be located extremely deep into the earth and subject to intense environmental conditions, making the sensor, and maintenance thereof, expensive. Moreover, such an arrangement would involve finding a way for the remote underground sensor to communicate with the above-ground control system, thereby raising an additional challenge.

Another way to control a pumpjack is to measure the mechanical force experienced by certain system components over the duration of an upstroke and/or a downstroke. Force may be measured in a variety of ways, such as using a conventional downhole card inside the well and/or a dynamometer coupled to an above-ground portion of the pumpjack system. When the measured force is graphed against the displacement of the travelling valve of the downhole pump (or against the displacement of any other reciprocating or rotating portion of the pumpjack), such a graph results in a curve that is known to provide useful information about the conditions experienced by the downhole pump.

Another way to control a pumpjack is to measure the torque experienced by a component of the pumpjack such as the prime mover 105. Torque may be measured in a variety of ways, such as using an ammeter on current fed to a prime mover 105 (if prime mover 105 is an electric motor). When the measured torque is graphed against the displacement of a reciprocating component of the pumpjack system such as the reciprocating polished rod 107, such a graph results also in a curve that is known to provide information that may be used to estimate various conditions experienced by the pumpjack system 100, such as pump fill and/or whether a pump-off condition exists.

Figure 4:
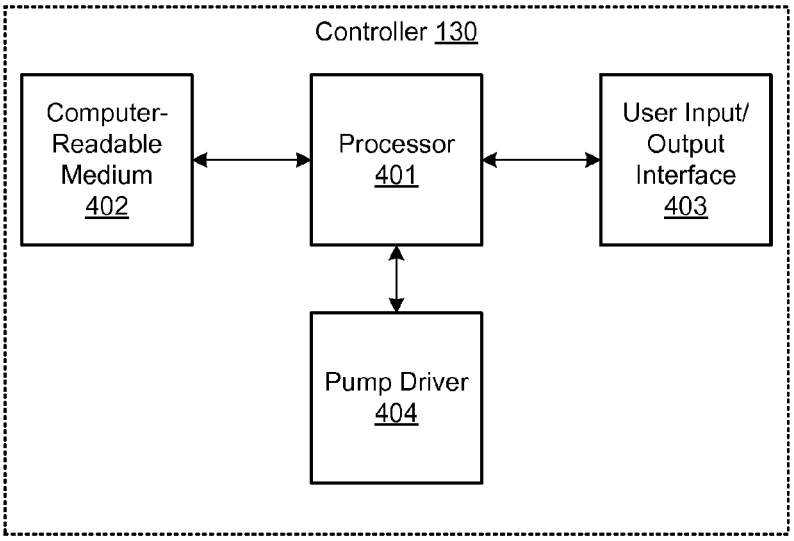
FIG. 4 is a block diagram of an example controller that may be used to perform various functions.

Any of the functions and steps described herein may be performed and/or controlled by controller 130. An example block diagram of controller 130 is shown in FIG. 4. Controller 130 may be or otherwise include a computer, and may include hardware that is hard-wired to perform specific functions and/or hardware that may execute software to perform specific functions. The software, if any, may be stored on a non-transitory computer-readable medium 402 in the form of computer-readable instructions. Controller 130 may read those computer-readable instructions, and in response perform various steps as defined by those computer-readable instructions. Thus, for example, any of the steps and functionality described in connection with FIGS. 5-8 may be implemented, for example, by reading and executing such computer-readable instructions for performing such steps and implementing such functionality, and/or by any hardware subsystem (e.g., a processor 401) from which controller 130 is composed. Processor 401 may be implemented as, for example, a central processing unit (CPU), an application-specific integrated circuit (ASIC), a field-programmable gate array (FPGA), and/or a programmable logic controller (PLC). Additionally or alternatively, any of the above-mentioned functions may be implemented by the hardware of controller 130, with or without the execution of software.

Computer-readable medium 402 may include not only a single physical non-transitory storage medium or single type of such medium, but also a combination of one or more such storage media and/or types of such media. Examples of computer-readable medium 402 include, but are not limited to, one or more memory chips, hard drives, optical discs (such as CDs or DVDs), magnetic discs, and magnetic tape drives. Computer-readable medium 402 may be physically part of, or otherwise accessible by, controller 130, and may store computer-readable instructions (e.g., software) and/or computer-readable data (i.e., information that may or may not be executable).

Controller 130 may also include a user input/output interface 403 for receiving input from a user (e.g., via a keyboard, mouse, and/or remote control) and/or for providing output to the user (e.g., via display device, an audio speaker, and/or a printer). For example, user input/output interface 403 may be used to indicate pump ON or OFF status, time remaining until pump ON or OFF, pump fill, and/or any other desired information.

Controller 130 may further include a pump driver 404 for controlling whether prime mover 105 will operate to cause pumping action. For example, pump driver 404 may cause prime mover 105 to turn on and off as desired. In some embodiments, controller 130, via pump driver 404, may cause prime mover 105 to turn on or off, or otherwise adjust its operation, such as changing the speed of the pump (changing the stroke speed). As will be discussed, such pump control operations may be performed in response to a pump off condition and/or another factor such as the expiration of a timer and/or based on gas production rate.

Figure 5:
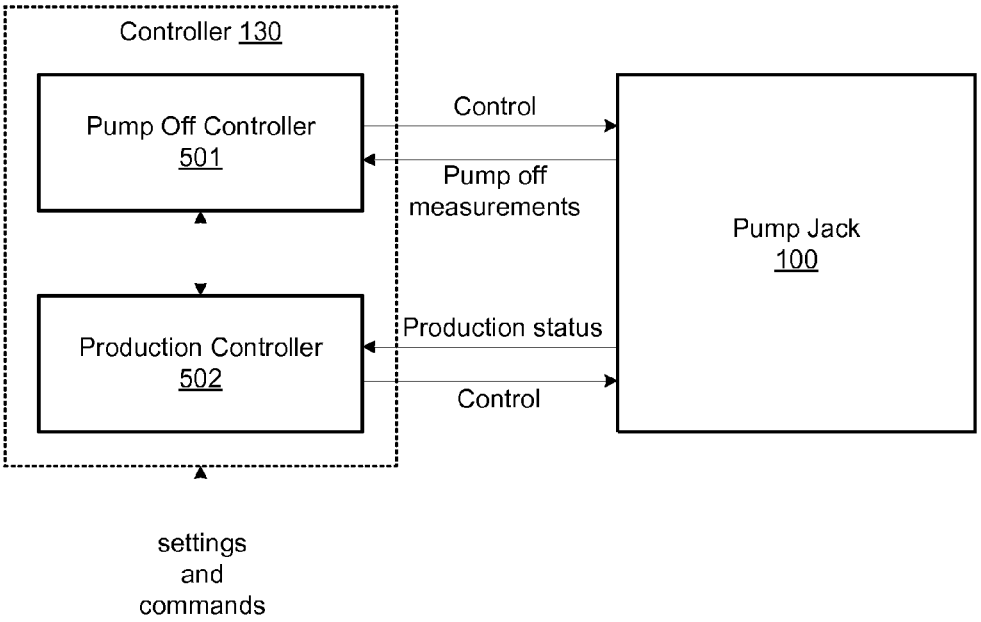
FIG. 5 is another block diagram of an example controller, including a pump off controller and a production controller.

FIG. 5 is another block diagram of an example controller, including a pump off controller 501 and a production controller 502. Pump off controller 501 and production controller 502 may be physically separate units, or they may be integrated as a single controller with the functionality of both controllers 501, 502. For example, controller 130 may implement one or both of pump off controller 501 and production controller 502. In some embodiments, pump off controller 501 and production controller 502 may utilize the same physical processor 401, but may be implemented using different portions of the above-mentioned computer-executable instructions. In other embodiments, pump off controller 501 and production controller 502 may utilize different physical processors and/or other hardware, and may communicate with each other in a wired and/or wireless manner. In either case, if production controller 501 is already in operation in the field, rather than replace the entire controller 301, production controller 502 may be retrofitted with production controller 502, such as via a software upgrade to controller 103 and/or as a hardware addition to controller 103.

Pump off controller 501 may be configured to control the ON and OFF states of pump jack system 100 in response to one or more measurements relevant to a pump off condition, and/or responsive to the expiration of a timer. For instance, pump off controller 501 may be configured to turn the pump ON until either a pump off condition is detected or a timeout occurs, whichever occurs first. Examples of measurements that may be relevant to a pump off condition include, as discussed previously, torque and/or force measurements.

Production controller 502 may be configured to modify the operation of the pump based on actual production measurements. This may be done in various ways. For example, production controller 502 may provide an input to pump off controller 501, which may cause pump off controller 501 to modify how it controls the pump. Alternatively, production controller 502 may directly control the pump. In the latter case, commands from pump off controller 501 and production controller 502 to the pump may be arbitrated in the event of conflicting commands. For example, a command to turn or maintain the pump OFF by either of the controllers 501, 502 may take precedence over a command to turn or maintain the pump ON. Or, a command to turn or maintain the pump ON by either of the controllers 501, 502 may take precedence over a command to turn or maintain the pump OFF.

At a high level, pump off controller 501 and production controller 502 together (e.g., as controller 130) may operate, for example, as shown below in Table 1. This example assume that the production product is gas (e.g., natural gas), and that downhole pump 117 is used mostly for removing waste products (e.g., water and other liquids) from annulus 115 to make room for the desirable natural gas to enter annulus 115 and rise upward for collection. While the waste products may themselves include one or more desirable products, such as oil, for the present example it will be assumed that production refers only to the gas that is produced for collection.

TABLE 1

| Pump Status | Production | Pump Control Action | OFF Time Adjustment |
|---|---|---|---|
| ON | steady | stay ON, unless production is consistent for threshold time; otherwise turn pump OFF | increase |
| | increasing | stay ON | decrease |
| | decreasing | turn pump OFF | increase |
| OFF | steady | stay OFF, unless maximum OFF time is reached | increase |
| | increasing | stay OFF, unless maximum OFF time is reached | increase |
| | decreasing | turn pump ON | decrease |

The example operation according to Table 1 is arranged such that the system is biased to maintain production while not expending energy (by operating the pump) unless it is deemed necessary. In comparison with a simple ON/OFF time pump off controller, utilizing the above operating principle may result in a relative increase in production, and possibly a relative decrease in energy expenditure, or at least a relatively small increase in energy expenditure compared with the increase in production. Variations on the operating characteristics of Table 1 may be used, while still achieving increased production in an efficient manner.

Studying the example of Table 1 more closely, it will be seen that the pump is turned to (or maintained in) an ON state only if the ON state is apparently benefitting production. That is, if gas production is increasing while the pump is in the ON state, the system will maintain the ON state in the hope that this will continue to cause production to increase, at least for some period of time. And, if production is steady (e.g., relatively constant, such as within an upper and lower threshold, or having a very small slope), then the pump may remain ON (because it can be assumed that the status quo may be helping to maintain production). However, if production is steady for an extended period of time, then the pump may be turned OFF.

Likewise, if the pump is in the OFF state, then according to Table 1, the system would be reluctant to turn the pump ON unless the OFF state is associated with decreasing production. Thus, there is a bias in this example to maintain the pump in an OFF state unless it is deemed likely that the ON state would benefit production.

Another potential consequence of operating the system in accordance with the above operating principle (e.g., Table 1), is that the level of the liquid at the bottom of annulus 115 may be naturally maintained at a level resulting in high production, and possibly even optimal production for the operating conditions. This may mean that the level of the liquid may be generally located somewhere between the intake of downhole pump 117 and the bottom of perforations 121. For instance, depending upon the particular operating conditions, this operating principle may be expected to potentially result in the liquid level being maintained very close to the bottom of perforations 121. This may be in contrast to many systems using a simple conventional pump off controller, in which the liquid level is typically maintained very close to the intake of downhole pump 117.

Production data for use with Table 1 may be collected by, e.g., measurement device 112. While the raw production data may be used directly to determine whether production is steady, increasing, or decreasing, it may be desirable for various reasons to pre-process, or condition, the production data. For instance, the raw production data may be highly variable over short periods of time, which may cause the control system to act in an unstable manner.

Figure 6:
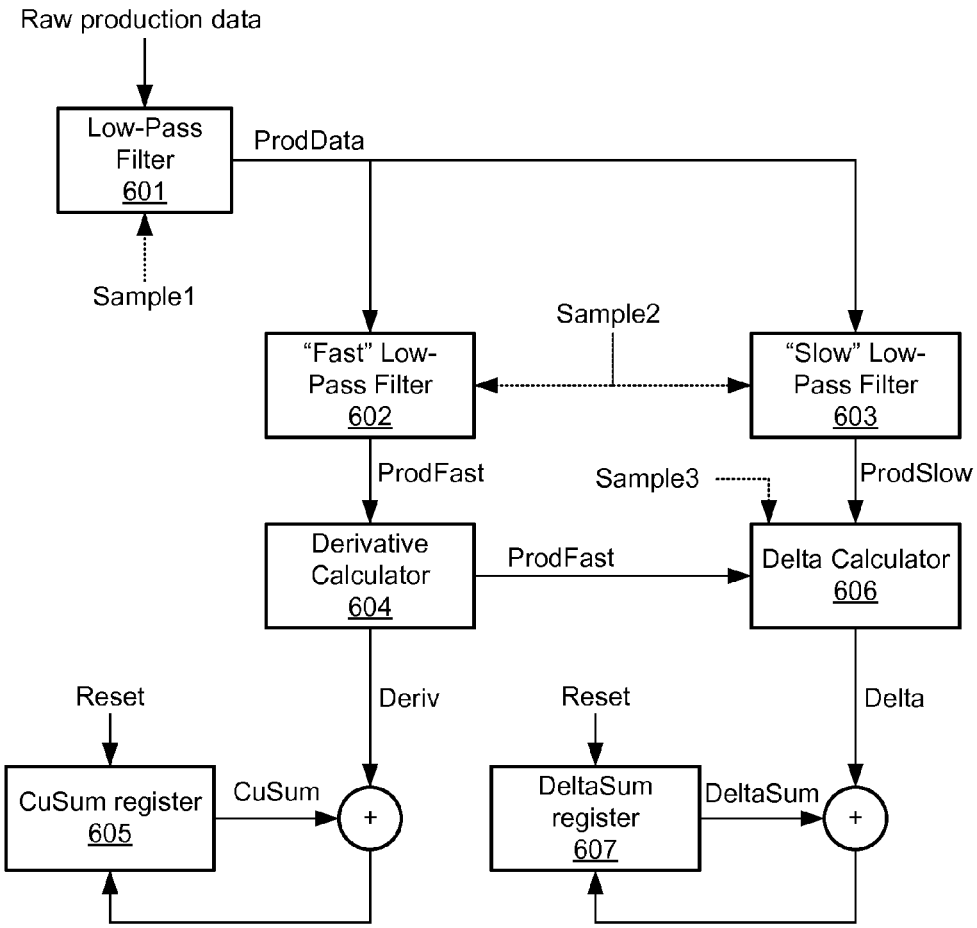
FIG. 6 is a block diagram of an example production data conditioner.

FIG. 6 is a block diagram of an example production data conditioner that may generate indicators based on the raw production data. The indicators, rather than the raw production data, may be used to determine whether production is steady, increasing, or decreasing. In the example of FIG. 6, it is assumed that the raw production data is an analog signal, as opposed to digital data. However, the raw production data may be digital data. The raw production data may be produced and/or sampled on a periodic basis.

The raw production data may be filtered by a low-pass filter 601 to generate a data signal referred to herein as ProdData. Low-pass filter 601 produces ProdData at a sampling period referred to herein as Sample1, which may have a sampling period appropriate for the sensor and overall system design of, e.g., less than one second (e.g., twenty milliseconds), or some number of seconds. Again, all time periods discussed herein are merely examples.

Next, ProdData may be filtered by two parallel low-pass filters 602 and 603. Low-pass filter 602 is referred to herein as a "high-cutoff" low-pass filter, and low-pass filter 603 is referred to herein as a "low cutoff" low-pass filter. The "high-cutoff" and "low-cutoff" designations are relative and refer to how much of the higher-frequency components are suppressed by the filters—the "low-cutoff" low-pass filter 603 suppresses more higher-frequency components (has a narrower passband) than the "high-cutoff" low-pass filter 602. Each of these filters 602, 603 produce a data signal at a sampling rate of Sample2, which may be equal to or longer than Sample1. For example, where the period of Sample1 is twenty milliseconds, the period of Sample2 may be one or more orders of magnitude longer than Sample1, such as one minute or longer. The output data signal of "high-cutoff" low pass filter 602 is referred to herein as ProdFast, and the output data signal of "low-cutoff" low pass filter 603 is referred to herein as ProdSlow, each of which may include a Sample2 period series of data. ProdSlow may represent a filtered version of the raw production data that, relatively speaking, does not readily respond to variations in the raw production data. Thus, ProdSlow may be considered to generally represent a short-term average baseline value of the production data. ProdFast, on the other hand, may represent a filtered version of the raw production data, but one that responds more readily to higher-frequency variations in the raw production data (while still suppressing much higher frequency variations that may represent noise or anomalies).

Next, a derivative calculator 604 may be used to calculate the derivative of ProdFast, and to output the calculated derivative as a data signal referred to herein as Deriv. In alternative embodiments, derivative calculator 604 may not take a true derivative, but instead may calculate another type of delta value. ProdSlow, in the meantime, may be processed by a delta calculator 606 to calculate a delta, which may be calculated, for example, as follows: Delta=100×(ProdFast−ProdSlow)/ProdSlow. The resulting data signal Delta may be considered to generally represent a short-term change from the average baseline value represented by ProdSlow.

Next, Deriv is accumulated over time, and the accumulated value CuSum is stored in a register referred to herein as CuSum register 605. Likewise, Delta is also accumulated over time, and the accumulated value DeltaSum is stored in a register referred to herein as DeltaSum register 607. As will be discussed below, CuSum and/or DeltaSum may be used as indicators from which decisions may be made as to whether production is currently steady, increasing, or decreasing.

Figure 7:
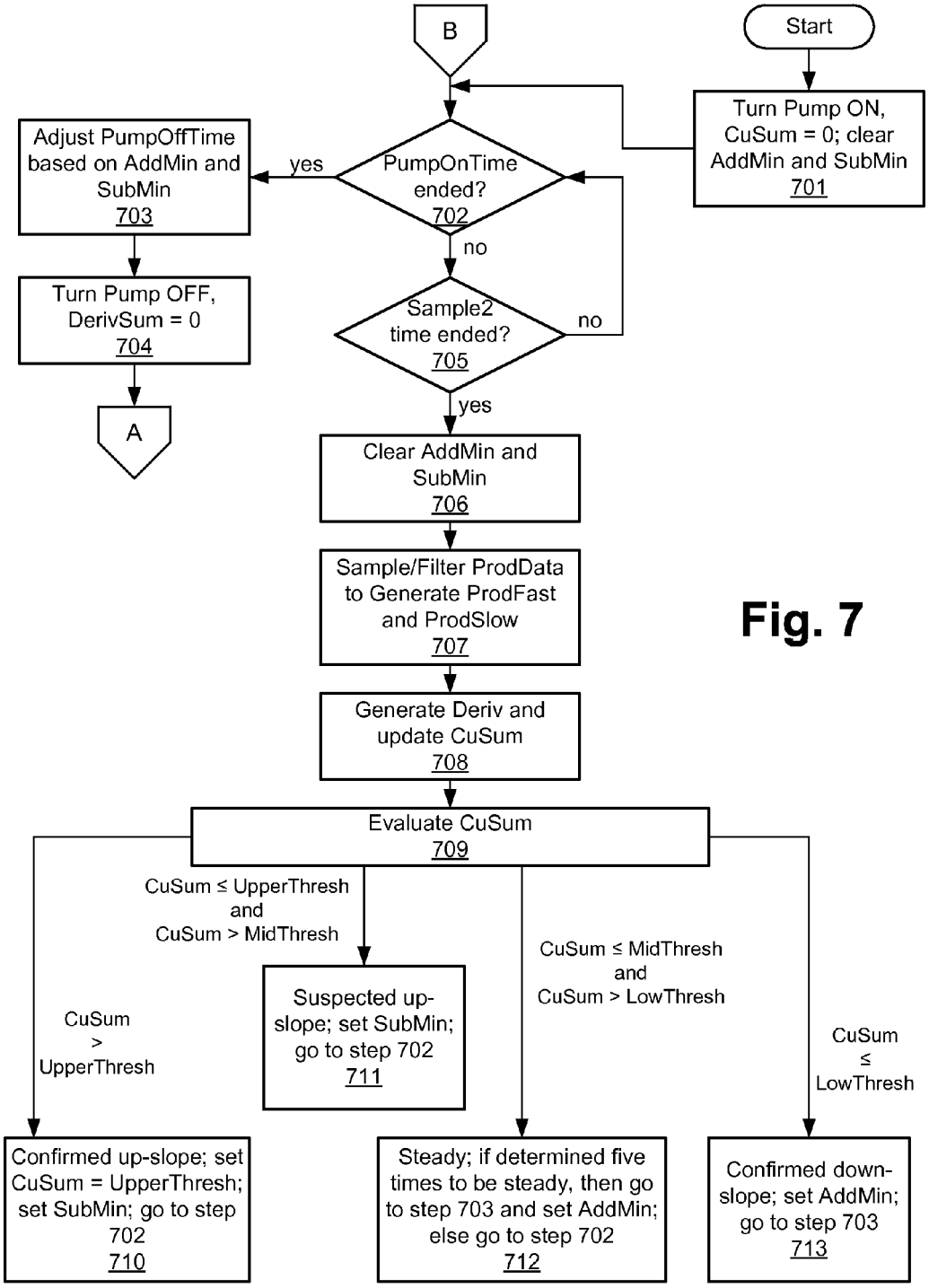
FIGS. 7 and 8 are a flow chart showing example steps that may be performed to control a pump.
Figure 8:
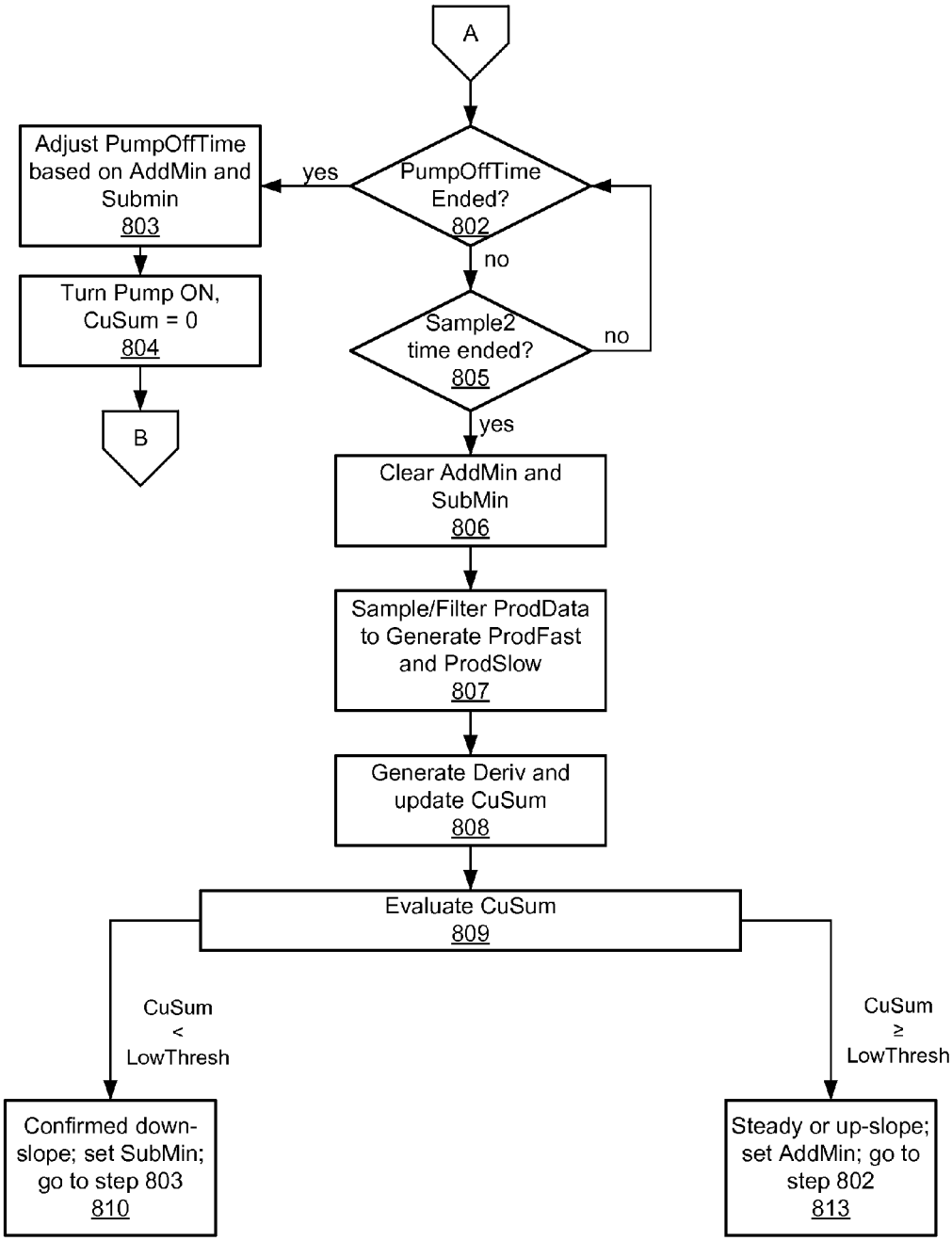

FIGS. 7 and 8 are a flow chart showing example steps that may be performed to control a pump, and may operate based on the values of CuSum and/or DeltaSum. The process of FIG. 7 may be performed while the pump is in the ON state, and the process of FIG. 8 may be performed while the pump is in the OFF state.

Referring first to FIG. 7, pumpjack system 100 (and/or controller 130) may be turned on or otherwise started, at which time the process of FIG. 7 may begin at step 701. At step 701, the pump may be turned on (such as by controlling prime mover 105) to the ON state, and CuSum may be cleared by setting it to zero. In addition, one or more flags indicating whether a pump off time should be increased or decreased may be cleared. In the example embodiment of FIG. 7, a flag called AddMin, when set, may indicate that the pump off time should be increased, such as by one minute or another period of time, and another flag called SubMin, when set, may indicate that the pump off time should be decreased, such as by one minute or another period of time. The pump off time would be the amount of time that the pump would remain in an OFF state, as monitored by a timer. The value of the pump off time is referred to herein as PumpOffTime. In alternative embodiments, AddMin and SubMin may be embodied as a single flag, where one value representing increasing the pump off time and another value represents decreasing the pump off time.

There may also be a defined pump on time, monitored by a timer and represented in this case by the value PumpOnTime. At step 702, it may be determined whether PumpOnTime has ended or expired, and if so, then at step 703, PumpOffTime is increased or decreased, e.g., by one minute, depending upon whether AddMin or SubMin is set. At step 704, the pump is turned OFF and CuSum is cleared again by setting it to zero. The process would then move to FIG. 8, which will be discussed later below.

If, at step 702, it is determined that PumpOnTime has not yet ended, then the process may move to step 705, in which it is determined whether the current Sample2 period has ended.

As discussed previously, Sample2 refers to the time period at which the data series of ProdFast and ProdSlow are generated. Sample2 may be, for example, one minute. If the current Sample2 period has not ended, then the process cycles back to step 702.

Once it is determined at step 705 that Sample2 has ended, the process moves to step 706 and clears AddMin and SubMin. Also, at step 707, a new value of each of ProdFast and ProdSlow is generated, and at step 708, Deriv is generated and CuSum is updated with the most recent value of Deriv, by adding the most recent value of Deriv to the previous value of CuSum.

Next, at step 709, the value of CuSum may be evaluated and compared with one or more thresholds. The result of this evaluation may determine whether production is considered to be in one of four states: confirmed up-slope (confirmed increasing), suspected up-slope (suspected increasing), steady zone, and confirmed down-slope (confirmed decreasing). The thresholds may include an upper threshold referred to herein as UpperThresh, a middle threshold referred to herein as MidThresh, and a lower threshold referred to herein as LowThresh. The threshold values may be set to any values as desired. In one example, UpperThresh may be equal to 5.0, MidThresh may be equal to 2.5, and LowThresh may be equal to −10.0. However, these values are merely examples and should not be considered as limiting to the present invention.

If it is determined that CuSum is greater than UpperThresh, then it may be concluded that there is a confirmed up-slope in production. In this case, at step 710, CuSum may be set equal to UpperThresh, the SubMin flag may be set (indicating a desire to reduce the amount of PumpOffTime, such as by one minute), and the process may move to step 702. The pump remains ON for now, because the assumption is that the current pump state (ON) is benefitting production.

If it is determined that CuSum is greater than MidThresh and CuSum is less than or equal to UpperThresh, then it may be concluded that there is a suspected up-slope in production. In this case, at step 711, the SubMin flag may be set (indicating a desire to reduce the amount of PumpOffTime, such as by one minute), and the process may move to step 702. The pump remains ON for the time being, because the assumption is that the current pump state (ON) is benefitting production.

If it is determined that CuSum is greater than LowThresh and CuSum is less than or equal to MidThresh, then it may be concluded that production is currently steady. In this case, at step 712, the process may move to step 702 unless this is the fifth time in a row that step 712 has been executed (i.e., that it has been concluded that production is steady). This implies that production is neither improving nor declining while the pump is running If that is the case, then AddMin may be set (indicating a desire to increase the amount of PumpOffTime, such as by one minute) and the process may instead move to step 703, thereby also causing the pump to change to the OFF state at step 704. The pump is turned OFF because the assumption is that running the pump is not necessarily helping production, and running the pump at this point may not result in a sufficient increase in production to justify running pump. Thus, continuing to run the pump may be considered a waste of energy and may incur unnecessary wear and tear on the pump apparatus.

If it is determined that CuSum is less than or equal to LowThresh, then it may be concluded that there is a confirmed down-slope in production. In this case, at step 713, the AddMin flag may be set, and the process may move to step 703, thereby also causing the pump to change to the OFF state at step 704. Again, the assumption here is that running the pump is not helping production, so the pump is turned off to avoid unnecessarily expending energy.

Thus, while the pump is ON, if production is deemed to be decreasing or is deemed to be steady over a sufficient period of time, then the process may cause the pump to turn OFF. Otherwise, the pump remains ON. This is consistent with the example of Table 1.

Once the pump is turned OFF at step 704, the process may move to step 802 of FIG. 8. At step 802, it may be determined whether PumpOffTime has ended or expired, and if so, then at step 803, PumpOffTime is increased or decreased, e.g., by one minute, depending upon whether AddMin or SubMin is set. At step 804, the pump is turned ON and CuSum is again cleared by setting it to zero. The process would then move back to step 702 of FIG. 7, which has already been discussed.

If, at step 802, it is determined that PumpOffTime has not yet ended, then the process may move to step 805, in which it is determined whether the current Sample2 period has ended. If the current Sample2 period has not ended, then the process cycles back to step 802.

Once it is determined at step 805 that Sample2 has ended, the process moves to step 806 and clears AddMin and SubMin. Also, at step 807, a new value of each of ProdFast and ProdSlow is generated, and at step 808, Deriv is generated and CuSum is updated with the most recent value of Deriv, by adding the most recent value of Deriv to the previous value of CuSum.

Next, at step 809, the value of CuSum may be evaluated and compared with one or more thresholds. The result of this evaluation may determine whether production is considered to be in one of two states: (1) confirmed down-slope and (2) steady or confirmed up-slope.

If it is determined that CuSum is less than LowThresh, then it may be concluded that there is a confirmed down-slope in production. In this case, at step 810, the SubMin flag may be set and the process may move to step 803, such that the pump is turned back ON at step 804. This is because the assumption is that the OFF state of the pump is harming production.

If it is determined that CuSum is greater than or equal to LowThresh, then it may be concluded that production is either steady or has a confirmed up-slope. In this case, at step 813, the AddMin flag may be set and the process may move to step 802. The pump remains OFF for now, because the assumption is that leaving the pump OFF is not harming production, and that expending additional energy to run the pump may not be expected to result in a sufficient increase in production.

Thus, while the pump is OFF, if production is deemed to be decreasing, then the process may cause the pump to turn ON. Otherwise, the pump remains OFF. This is consistent with the example of Table 1.

In addition to the above-discussed process of FIG. 8, a parallel process may run in which DeltaSum and/or Delta may be evaluated periodically, say every five Sample2 periods (e.g., every five minutes). If it is determined that Delta is less than LowThresh and/or DeltaSum is less than LowThresh, then PumpOffTime may be immediately reduced (shortened) by a greater amount than would be caused by setting SubMin (e.g., by five minutes). If this shortening of PumpOffTime causes PumpOffTime to be less than or equal to zero, then this may cause the process to immediately jump to step 804, such that the pump is immediately turned ON. Otherwise, the process continues in its current state.

If the immediate reduction in PumpOffTime causes the process to jump to step 804 (thus turning on the pump) at least a predetermined number of times in a row (e.g., three times in a row), then the conclusion may be that the process is not helping, and that possibly ProdSlow is not keeping up with current baseline values. In this case, ProdSlow may be set equal to ProdFast, and the process of FIGS. 7 and 8 continued.

In the above discussion with regard to FIGS. 7 and 8, the process may alternatively be implemented in which one or more of the less-than conditions may be replaced with less-than-or-equal-to conditions and/or vice-versa, and/or one or more of the greater-than conditions may be replaced with greater-than-or-equal-to conditions and/or vice-versa. In addition, while particular examples methods of determining whether the production rate is increasing, decreasing, or steady have been described, such a determination may be performed in any of a number of ways, and may even involve a direct evaluation of the raw production signal without the above-described pre-processing of FIG. 6, or using a different type of pre-processing. Moreover, there are many other ways of implementing the actions set forth in example Table 1.

In addition, while the above examples have assumed that the pump may change between a single ON state and a single OFF state, in further embodiments the pump may be controlled by controller 130 to have multiple speeds (e.g., multiple ON states). In such embodiments, where the process calls for changing the state of the pump from an ON state to an OFF state, the process may instead changing the state of the pump by reducing the speed of the pump. And, where the process calls for changing the state of the pump from an OFF state to an ON state (and where in these embodiments the pump had been previously slowed rather than actually turned OFF), the process may instead change the state of the pump by increasing the speed of the pump.

Moreover, any or all of the functions and steps described herein with regard to FIGS. 6-8 may be performed in whole or in part by controller 130. Any of the blocks and steps of FIG. 6-8 may be implemented as software modules (e.g., in the form of computer-readable instructions) and/or as hardware, such as circuitry, of controller 130. Moreover, some or all of the functions and steps of FIGS. 6-8 may be performed by production controller 502 of controller 130 and/or by pump off controller 501 of controller 130.

Thus, various example systems, methods, and software have been described that may be used to control the production efficiency of a pumpjack or other pumping system, using as a feedback mechanism information about the actual current and/or past production. While embodiments of the present invention have been illustrated and described, it is not intended that these embodiments illustrate and describe all possible forms of the present invention. Rather, the words used in the specification are words of description rather than limitation, and it is understood that various changes may be made without departing from the spirit and scope of the present disclosure.

The invention claimed is:

1. A method of controlling a pump configured to pump liquid out of a well, comprising:

determining, by a computer, a plurality of production rates of gas from the well;

calculating at least one derivative of data representing the plurality of production rates of the gas;

using the at least one derivative to determine whether the plurality of production rates of the gas are decreasing or increasing;

changing a state of the pump responsive to determining to that a first one of the plurality of production rates of the gas is decreasing; and maintaining the state of the pump responsive to determining that a second one of the plurality of production rates of the gas is increasing.

2. The method of claim 1, further comprising changing a pump off time of the pump responsive to the determining that the first one of the plurality of production rates of the gas is decreasing.

3. The method of claim 2, wherein the changing the state of the pump comprises changing the state of the pump from an OFF state to an ON state and the changing the pump off time comprises decreasing the pump off time.

4. The method of claim 2, wherein the changing the state of the pump comprises changing the state of the pump from an ON state to an OFF state and the changing the pump off time comprises increasing the pump off time.

5. The method of claim 1, wherein the state of the pump is OFF, and wherein the method comprises maintaining the pump in the OFF state responsive to the determining that the second one of the plurality of production rates of the gas is increasing and responsive to determining that the pump has remained in the OFF state for less than a predetermined amount of time.

6. The method of claim 1, further comprising measuring the plurality of production rates of the gas.

7. A method of controlling a pump configured to pump liquid out of a well, comprising:

determining, by a computer, whether a production rate of gas is increasing, decreasing, or steady;

determining, by the computer, what state the pump should be in according to the following:

(1) while the pump is in an ON state and the production rate of the gas is determined to be steady, maintain the pump in the ON state and increase a pump off time of the pump, (2) while the pump is in the ON state and the production rate of the gas is determined to be increasing, maintain the pump in the ON state and decrease the pump off time of the pump, (3) while the pump is in the ON state and the production rate of the gas is determined to be decreasing, switch the pump to an OFF state and increase the pump off time of the pump, (4) while the pump is in the OFF state and the production rate of the gas is determined to be steady, maintain the pump in the OFF state and increase the pump off time of the pump, (5) while the pump is in the OFF state and the production rate of the gas is determined to be increasing, maintain the pump in the ON state and increase the pump off time of the pump, and (6) while the pump is in the OFF state and the production rate of the gas is determined to be decreasing, switch the pump to the ON state and decrease the pump off time of the pump; and responsive to determining to that the state of the pump should change between the ON state and the OFF state, changing the state of the pump between the ON state and the OFF state.

8. A method of controlling a pump configured to pump liquid out of a well, comprising:

measuring a production rate of gas from the well;

determining, by a computer, whether the production rate of the gas is increasing, decreasing, or steady;

increasing a pump off time of the pump responsive to determining that the production rate of the gas is steady;

determining, after said increasing, whether the production rate of the gas remains steady for at least a predetermined period of time; and responsive to determining that the production rate of the gas has remained steady for at least the predetermined period of time, changing a state of the pump.

9. The method of claim 8, further comprising:

responsive to said determining that the production rate of the gas is steady and prior to said changing the state of the pump, maintaining a state of the pump to be a same state as when the production rate of the gas was measured during said measuring.

10. The method of claim 8, wherein the changing the state of the pump comprises hanging the state of the pump from an ON state to an OFF state.

11. The method of claim 8, wherein said determining the production rate of the gas comprises filtering data representing measured gas production through a low-pass filter.

12. The method of claim 8, wherein said determining whether the production rate of the gas is increasing, decreasing, or steady comprises comparing the production rate of the gas to an upper threshold value and a lower threshold value.

13. A method of controlling a pump configured to pump liquid out of a well, comprising:

receiving a first signal representing a measured production rate of gas from the well; and filtering the first signal using a first low-pass filter to obtain a second signal, filtering the first signal using a second low-pass filter having filter characteristics different from the first low-pass filter to obtain a third signal;

determining, by a computer, using both the second signal and the third signal, a plurality of directions of change of the production rate of gas;

responsive to determining that a first one of the plurality of directions of change is an increasing direction while the pump is in an ON state, decreasing a pump off time of the pump; and responsive to determining that a second one of the plurality of directions of change is a decreasing direction while the pump is in the ON state, switching the pump to an OFF state and increasing the pump off time of the pump.

14. The method of claim 13, further comprising:

responsive to determining that the first one of the plurality of directions of change is the increasing direction while the pump is in the OFF state, increasing the pump off time of the pump, and responsive to determining that the second one of the plurality of directions of change is the decreasing direction while the pump is in the OFF state, switching the pump to the ON state and decreasing the pump off time of the pump.

15. The method of claim 14, further comprising switching the pump from the OFF state to the ON state responsive to determining that the pump off time of the pump has expired.

16. The method of claim 14, wherein the increasing the pump off time of the pump comprises increasing the pump off time after the pump off time has expired.

17. The method of claim 14, wherein the switching the pump to the ON state comprises switching the pump to the ON state before the pump off time has expired.

18. The method of claim 13, further comprising:

responsive to determining that a third one of the plurality of directions of change is neither the increasing direction nor the decreasing direction, increasing the pump off time of the pump.

* * * * *